US010240791B2

(12) United States Patent
Nagai et al.

(10) Patent No.: US 10,240,791 B2
(45) Date of Patent: Mar. 26, 2019

(54) COMBUSTION BURNER, COMBUSTOR, AND GAS TURBINE HAVING A SWIRL VANE WITH OPPOSITE DIRECTED SURFACES

(71) Applicant: MITSUBISHI HEAVY INDUSTRIES, LTD., Tokyo (JP)

(72) Inventors: Naonori Nagai, Tokyo (JP); Katsuyoshi Tada, Tokyo (JP); Kei Inoue, Tokyo (JP); Keijiro Saito, Tokyo (JP)

(73) Assignee: MITSUBISHI HEAVY INDUSTRIES, LTD., Tokyo (JP)

( * ) Notice: Subject to any disclaimer, the term of this patent is extended or adjusted under 35 U.S.C. 154(b) by 48 days.

(21) Appl. No.: 14/897,814

(22) PCT Filed: Jan. 23, 2015

(86) PCT No.: PCT/JP2015/051797
§ 371 (c)(1),
(2) Date: Dec. 11, 2015

(87) PCT Pub. No.: WO2016/042787
PCT Pub. Date: Mar. 24, 2016

(65) Prior Publication Data

US 2016/0298845 A1 Oct. 13, 2016

(30) Foreign Application Priority Data

Sep. 19, 2014 (JP) ..... 2014-192017

(51) Int. Cl.
*F23R 3/14* (2006.01)
*F23R 3/28* (2006.01)
(Continued)

(52) U.S. Cl.
CPC ..... *F23R 3/14* (2013.01); *F23R 3/002* (2013.01); *F23R 3/283* (2013.01); *F23R 3/286* (2013.01);
(Continued)

(58) Field of Classification Search
CPC .... F23D 11/103; F23D 11/105; F23D 11/107; F23D 11/383; F02C 7/22
See application file for complete search history.

(56) References Cited

U.S. PATENT DOCUMENTS 5,251,447 A * 10/1993 Joshi ..... F23R 3/14 239/403
5,647,200 A * 7/1997 Althaus ..... F02K 3/10 60/39.17
(Continued)

FOREIGN PATENT DOCUMENTS

CN 1707163 12/2005
CN 103003552 3/2013
(Continued)

OTHER PUBLICATIONS

Decision to Grant a Patent dated Mar. 4, 2016 in corresponding Japanese Application No. 2014-192017 (with English translation).
(Continued)

*Primary Examiner* — Todd E Manahan
*Assistant Examiner* — Eric Linderman
(74) *Attorney, Agent, or Firm* — Wenderoth, Lind & Ponack, L.L.P.

(57) ABSTRACT

A combustion burner includes a nozzle and a swirl vane disposed in an axial flow path extending along an axial direction of the nozzle. The swirl vane includes a tip portion for swirling gas, the gas flowing through a radially-outer region of the axial flow path, and a root portion disposed on an inner side in a radial direction of the nozzle, the root
(Continued)

portion having a cutout on a side of a trailing edge. The radially-outer region and a radially-inner region of the axial flow path communicate with each other, at least in a range in the axial direction in which the swirl vane is disposed. The swirl vane has a pressure surface, a downstream region of the pressure surface of the root portion being defined by the cutout as a curved surface which curves in a direction opposite to the swirl direction toward the trailing edge.

13 Claims, 10 Drawing Sheets

(51) Int. Cl.
*F02C 7/22* (2006.01)
*F23D 11/10* (2006.01)
*F23R 3/00* (2006.01)

(52) U.S. Cl.
CPC .. *F23C 2900/07001* (2013.01); *F23D 11/103* (2013.01); *F23D 11/105* (2013.01); *F23D 11/107* (2013.01)

(56) References Cited

U.S. PATENT DOCUMENTS 5,827,054 A * 10/1998 Sarv ..... F23C 7/004 431/184
6,141,967 A * 11/2000 Angel ..... F23R 3/14 239/405
6,993,916 B2 2/2006 Johnson et al.
8,789,373 B2 * 7/2014 Huth ..... F23R 3/14 60/748
8,826,666 B2 9/2014 Kajimura et al.
9,062,885 B2 6/2015 Takami et al.
9,303,872 B2 * 4/2016 Hadley ..... F23R 3/20
9,518,740 B2 * 12/2016 Biagioli ..... F23R 3/14
9,638,040 B2 * 5/2017 Guemmer ..... F01D 5/14
2001/0023590 A1 * 9/2001 Mandai ..... F23R 3/14 60/747
2003/0014976 A1 1/2003 Mandai et al.
2003/0084667 A1 * 5/2003 Gerendas ..... F23R 3/14 60/748
2004/0020210 A1 2/2004 Tanaka et al.
2005/0268618 A1 12/2005 Johnson et al.
2007/0199327 A1 * 8/2007 Tanimura ..... F23R 3/04 60/740
2008/0148736 A1 * 6/2008 Ishizaka ..... F23R 3/14 60/737
2008/0289341 A1 * 11/2008 Ishizaka ..... F23R 3/14 60/748
2009/0025395 A1 * 1/2009 Nilsson ..... F23C 7/004 60/748
2009/0139236 A1 * 6/2009 Yilmaz ..... F23R 3/14 60/737
2009/0277178 A1 * 11/2009 Carroni ..... F23D 14/64 60/742
2009/0320485 A1 * 12/2009 Wilbraham ..... F23R 3/14 60/748
2010/0058767 A1 3/2010 Simons et al.
2010/0074757 A1 * 3/2010 Headland ..... F23C 7/004 416/227 R
2010/0205971 A1 * 8/2010 Williams ..... F23D 11/107 60/748
2010/0263381 A1 * 10/2010 Ishizaka ..... F23R 3/14 60/737
2012/0167570 A1 * 7/2012 Evulet ..... F23C 7/004 60/737
2012/0175430 A1 * 7/2012 Bathina ..... F23R 3/14 239/11
2012/0180490 A1 7/2012 Takami et al.
2012/0247110 A1 * 10/2012 Clemen ..... F02K 1/386 60/737
2012/0312890 A1 12/2012 Romig
2013/0255261 A1 * 10/2013 Abdelnabi ..... F23R 3/14 60/734
2015/0354825 A1 * 12/2015 Kajimura ..... F23R 3/14 239/399
2016/0215982 A1 * 7/2016 Pfeffer ..... B01F 5/0401
2017/0102147 A1 * 4/2017 Wang ..... F02C 3/04
2017/0292706 A1 * 10/2017 Inoue ..... F23R 3/14

FOREIGN PATENT DOCUMENTS

CN 103210257 7/2013
JP 6-94218 4/1994
JP 2003-42453 2/2003
JP 2003-83541 3/2003
JP 2005-351616 12/2005
JP 2007-285572 11/2007
JP 2009-133605 6/2009
JP 2010-60275 3/2010
JP 2010-223577 10/2010
JP 2010-249449 11/2010
JP 4719059 7/2011
JP 2012-145077 8/2012
JP 2013-194928 9/2013
JP 5501650 5/2014
JP 2014-101856 6/2014
JP 2015-183960 10/2015
JP 2015-209842 11/2015

OTHER PUBLICATIONS

International Search Report dated Apr. 28, 2015 in corresponding International Application No. PCT/JP2015/051797.
International Search Report dated Nov. 10, 2015 in corresponding International Application No. PCT/JP2015/073122.
International Preliminary Report on Patentability and Written Opinion of the International Searching Authority dated Mar. 30, 2017 in corresponding International (PCT) Application No. PCT/JP2015/073122, with English Translation.
Office Action dated Dec. 12, 2017 in Korean Application No. 10-2017-7005483, with English Translation.
Notification of Reasons for Refusal dated Jul. 13, 2018 in Japanese Patent Application No. 2014-190634, with English-language translation.
Office Action dated Dec. 11, 2018 in corresponding German Application No. 112015004264.4.

* cited by examiner

RELATED ART

COMBUSTION BURNER, COMBUSTOR, AND GAS TURBINE HAVING A SWIRL VANE WITH OPPOSITE DIRECTED SURFACES

TECHNICAL FIELD

The present disclosure relates to a combustion burner including swirl vanes disposed in an axial flow path around a nozzle, and a combustor and a gas turbine including the combustion burner.

BACKGROUND ART

Generally, a combustor for generating combustion gas includes a combustion burner for supplying a combustion space with fuel and an oxidant such as air to form flames. For instance, some combustors for a gas turbine are equipped with a premix combustion burner. A premix combustion burner includes an axial flow path formed radially outside a nozzle. Premix gas containing compressed air and fuel flows through the axial flow path. In a combustion burner of this type, a swirler is usually provided in the axial flow path to promote premix in many cases.

Meanwhile, it is known that the position of flames formed by a combustion burner is determined by a balance between the combustion velocity, which is a propagating velocity of the flames, and the axial-flow velocity of the gas flowing through the axial flow path. During normal combustion, flames are maintained at a position offset toward the downstream side from the combustion burner by a predetermined distance. However, in a case where the combustion burner includes a swirler, flashback (backfire) may occur, in which flames run backward toward the combustion burner. The flashback occurs due to the axial-flow velocity being lower in a region formed at the center of the swirl of the swirl flow formed by the swirler than in the surrounding region, and the combustion velocity exceeding the axial-flow velocity in this region with the lower axial-flow velocity to cause the flames to propagate excessively to the combustion burner. Frequent occurrence of flashback may bring about troubles such as damage due to burn of the combustion burner.

In view of this, to prevent flashback, the premix combustion burner described in Patent Document 1, for instance, includes a cutout on a rear edge at the radially inner side of a swirl vane. With such a premix combustion burner, a swirl air flow is formed along a curved surface at the radially outer side of the swirl vane. On the other hand, at the radially inner side of the swirl vane, compressed air flows downstream in the axial direction of the combustion burner through the cutout, and thus the axial-flow velocity increases at the radially inner side of the swirl vane (at the center of the swirl of the swirl flow). Further, as a technique related to the above, described in Patent Document 2 is a burner including a partition wall partitioning an air channel region at the radially inner side from an air channel region at the radially outer side, and swirl vanes disposed in the air channel region at the radially outer side. With this burner, air is not swirled in the air channel region at the radially inner side, so as to increase the axial-flow velocity at the inner side.

CITATION LIST

Patent Literature

Patent Document 1: JP2007-285572A
Patent Document 2: JP2010-223577A

SUMMARY

Problems to be Solved

However, with regard to the combustion burner described in Patent Document 1, while it is possible to suppress flashback to some extent by increasing the axial-flow component at the radially inner side of the swirler by the cutout, in reality separation of the flow occurs at the downstream side of the cutout to generate turbulence, which results in a great fluctuation of the axial-flow velocity with time. Thus, it is difficult to maintain an adequate axial-flow velocity stably, and flashback may occur.

Specifically, the axial-flow velocity at the downstream side of the cutout increases when the fluctuation component of the axial-flow velocity due to the turbulence is positive, and the axial-flow velocity at the downstream side of the cutout decreases when the fluctuation component of the axial-flow velocity is negative. Thus, when the fluctuation component of the axial-flow velocity becomes negative, the axial-flow velocity at the downstream side of the cutout decreases instantaneously and flashback is likely to occur.

In the burner described in Patent Document 2, since the air channel region at the radially inner side and the air channel region at the radially outer side are separated by the partition wall, air and fuel in the air channel regions are mixed with each other at the downstream side of the partition wall, which may lead to insufficient mixing.

In view of the above issues, an object of at least one embodiment of the present invention is to provide a combustion burner and a combustor whereby it is possible to improve the flashback-resistant property at the radially inner side of a swirler while maintaining a good mixing performance in an axial flow path around a nozzle.

Solution to the Problems

A combustion burner according to at least one embodiment of the present invention comprises: a nozzle; and a swirl vane disposed in an axial flow path extending along an axial direction of the nozzle around the nozzle. The swirl vane includes a tip portion for swirling gas in a swirl direction, the gas flowing through a radially-outer region of the axial flow path, and a root portion disposed on an inner side in a radial direction of the nozzle as seen from the tip portion, the root portion having a cutout on a side of a trailing edge. The radially-outer region and a radially-inner region of the axial flow path communicate with each other without being partitioned, at least in a range in the axial direction in which the swirl vane is disposed. The swirl vane has a pressure surface, a downstream region of the pressure surface of the root portion being defined by the cutout as a curved surface which curves in a direction opposite to the swirl direction toward the trailing edge.

Further, the trailing edge of the root portion of the swirl vane may be disposed on an upstream side in the axial direction and in the swirl direction, as compared to the trailing edge of the tip portion.

With the above combustion burner, at the tip portion of the swirl vane, the gas flowing through the radially outer region of the axial flow path (hereinafter, referred to as a radially-outer flow path region) is swirled. In this way, it is possible to promote premix of the gas and the fuel supplied to the axial flow path by the swirl flow formed by the tip portion. On the other hand, a cutout is formed on the downstream side of the root portion of the swirl vane, and the cutout forms a curved surface which curves in a direction opposite to the swirl direction toward the trailing edge in the downstream region of the pressure surface of the root portion. Thus, in the radially-inner region of the axial flow path (hereinafter, referred to as a radially-inner flow path region), the gas is attracted toward the curved surface by the Coanda effect to be rectified in a direction opposite to the swirl direction. As a result, the swirl component applied to the gas in the upstream region of the pressure surface of the root portion weakens in the downstream region of the pressure surface of the root portion, which increases the mean axial-flow velocity in the radially-inner flow path region and improves the flashback-resistant property. The gas further flows along the curved surface in the downstream region of the pressure surface of the root portion, which makes it possible to suppress occurrence of turbulence due to separation of the flow at the downstream side of the cutout, and to prevent the axial-flow velocity from becoming unstable due to a negative fluctuation component caused by such turbulence. Thus, it is possible to suppress a fluctuation in the axial-flow velocity in the radially-inner flow path region and to improve the flashback-resistant property.

Further, at least in a range in the axial direction in which the swirl vanes are provided, the radially-outer flow path region and the radially-inner flow-path region of the axial flow path of the combustion burner are communicating with each other without being partitioned. In this way, the mixing of the gas flowing through the radially-outer flow path region and the gas flowing through the radially-inner flow path region is promoted. Thus, the concentration distribution of the fuel supplied to the axial flow path is equalized in the radial direction of the combustion burner.

In some embodiments, the pressure surface of the swirl vane at the tip portion has a curved surface curving in the swirl direction toward the trailing edge, and the pressure surface of the swirl vane has a stepped portion between the curved surface of the tip portion and the curved surface of the root portion.

According to the above embodiment, at the stepped portion formed on the pressure surface of the swirl vane, a shear layer is formed between a flow in the swirl direction along the curved surface of the tip portion and a flow opposite to the swirl direction along the curved surface of the root portion. A swirl is generated at the shear layer, and the mixing of the gas flowing through the radially-outer flow path region and the gas flowing through the radially-inner flow path region is promoted. In this way, in a case where fuel is supplied at the upstream side of the swirl vane, it is possible to further equalize the distribution of the fuel concentration in the radial direction of the combustion burner.

In some embodiments, an airfoil of the root portion has a shape same as that of an airfoil of the tip portion in an upstream region, and has a shape such that a portion corresponding to the cutout is cut out from the airfoil of the tip portion in the downstream region.

In this way, formed is a blade member having a substantially constant airfoil over the entire length of the blade height, and the cutout is disposed in the downstream region of the root portion of the blade member. As a result, it is possible to easily produce a swirl vane having a curved surface curving in a direction opposite to the swirl direction at the root portion.

In one embodiment, the trailing edge of the root portion of the swirl vane is disposed on a position same as that of a leading edge of the root portion, in a circumferential direction of the nozzle.

According to the above embodiment, the trailing edge of the root portion returns to the same position as that of the leading edge in the circumferential direction by the curve curving in a direction opposite to the swirl direction. Thus, as compared to a case in which the trailing edge of the root portion of the swirl vane is offset toward the downstream side in the swirl direction from the leading edge, it is possible to mitigate the swirl component of the flow in the radially-inner flow path region sufficiently and increase the mean axial-flow velocity securely.

In one embodiment, the airfoil of the root portion of the swirl vane has a line-symmetric shape with respect to a straight line parallel to the axial direction and passing through the trailing edge, at least on the side of the trailing edge.

In this way, it is possible to increase the mean axial-flow velocity in the radially-inner flow path region and to simplify the cross-sectional shape of the root portion. In this case, it is possible to improve the manufacturability of the swirl vane.

In another embodiment, the trailing edge of the root portion of the swirl vane is disposed on a side opposite to the trailing edge of the tip portion across a straight line parallel to the axial direction and passing through the leading edge, in the circumferential direction of the nozzle.

In this way, the trailing edge of the root portion is positioned at the upstream side of the leading edge in the swirl direction, which makes it possible to orient the flow in the radially-inner flow path region securely in a direction opposite to the swirl direction, and to reduce the swirl component in the radially-inner flow path region even more effectively. As a result, it is possible to increase the mean axial-flow velocity in the radially-inner flow path region securely.

In some embodiments, the curved surface at the root portion is configured to swirl gas in a direction opposite to the swirl direction, the gas flowing through the radially-inner region of the axial flow path.

In this way, the gas swirls in the radially-inner flow path region in a direction opposite to the swirl direction of the radially-outer flow path region, which makes it possible to mitigate the swirl component in the radially-inner flow path region even more effectively.

In some embodiments, a bisector of an angle formed by a tangent of the pressure surface passing through the trailing edge of the root portion and a tangent of a suction surface passing through the trailing edge of the root portion is oblique to the axial direction in a direction opposite to the swirl direction, at a downstream side of the trailing edge.

According to the above embodiment, while the gas is swirling in the swirl direction in the radially-outer flow path region, the gas flows in a direction opposite to the swirl direction in the radially-inner flow path region. In this way, it is possible to mitigate the swirl component in the radially-inner flow path region even more effectively.

In some embodiments, the leading edge of the swirl vane is oblique to the radial direction toward an upstream side in the axial direction as the leading edge gets closer to an outer side in the radial direction of the nozzle, at least on a side of the tip portion. In this way, the flow of the gas gets closer to the radially-inner flow path region along the pressure gradient in the radial direction on the blade surface of the swirl vane, and thus the flow rate in the radially-inner flow path region increases relatively. As a result, the mean axial-flow velocity in the radially-inner flow path region increases.

In some embodiments, the tip portion includes a cutout-space forming surface disposed on a radially-outer side of a cutout space formed by the cutout, the cutout-space forming surface facing the cutout space, in a downstream region of the tip portion, and the cutout-space forming surface has a shape such that a width of the cutout space in the radial direction increases toward a downstream side.

In this way, it is possible to secure a large width where the flow mainly including the swirl flow in the radially-outer flow path region and the flow mainly including the axial flow passing through the cutout in the radially-inner flow path region are to be mixed with each other, which makes it possible to equalize the flow-velocity distribution at the downstream side of the axial flow path. The more uniform the flow-velocity distribution at the flame-holding position is, the closer the shape of the flame surface gets to a flat shape, and the smaller a baroclinic torque that causes the flame surface to flow backward to the upstream side becomes. Thus, with the flow-velocity distribution at the downstream side of the axial flow path being uniform, it is possible to improve the flashback-resistant property in the radially-inner flow path region effectively.

Further, the cutout-space forming surface may be a flat surface extending linearly and oblique to the axial direction so that the width of the cutout space in the radial direction increases toward the downstream side.

A combustion burner according to at least one embodiment of the present invention comprises: a nozzle; and a swirl vane disposed in an axial flow path extending along an axial direction of the nozzle and around the nozzle and configured to swirl at least a part of gas in a swirl direction, the gas flowing through the axial flow path. A leading edge of the swirl vane is oblique to a radial direction of the nozzle toward an upstream side in the axial direction as the leading edge gets closer to an outer side in the radial direction, at least on a side of a tip portion.

According to the above embodiment, the flow of the gas gets closer to the radially-inner flow path region along the pressure gradient in the radial direction on the blade surface of the swirl vane, and thus the flow rate in the radially-inner flow path region increases relatively. As a result, the mean axial-flow velocity in the radially-inner flow path region increases. Thus, it is possible to improve the flashback-resistant property.

A combustion burner according to at least one embodiment of the present invention comprises: a nozzle; and a swirl vane disposed in an axial flow path extending along an axial direction of the nozzle and around the nozzle.

The swirl vane includes a tip portion for swirling gas in a swirl direction, the gas flowing through a radially-outer region of the axial flow path, and a root portion disposed on an inner side as seen from the tip portion in a radial direction of the nozzle, the root portion having a cutout on a side of a trailing edge.

The radially-outer region and a radially-inner region of the axial flow path communicate with each other without being partitioned, at least in a range in the axial direction in which the swirl vane is disposed.

The tip portion includes a cutout-space forming surface disposed on an outer side, in the radial direction, of a cutout space formed by the cutout, the cutout-space forming surface facing the cutout space, in a downstream region of the tip portion.

The cutout-space forming surface has a shape such that a width of the cutout space in the radial direction increases toward a downstream side.

With the above combustion burner, it is possible to secure a large width where the flow mainly including the swirl flow in the radially-outer flow path region and the flow mainly including the axial flow passing through the cutout in the radially-inner flow path region are to be mixed with each other, which makes it possible to equalize the flow-velocity distribution at the downstream side of the axial flow path. The more uniform the flow-velocity distribution at the flame-holding position is, the closer the shape of the flame surface gets to a flat shape, and the smaller a baroclinic torque that causes the flame surface to flow backward to the upstream side becomes. Thus, with the flow-velocity distribution at the downstream side of the axial flow path being uniform, it is possible to improve the flashback-resistant property in the radially-inner flow path region effectively.

Further, at least in a range in the axial direction in which the swirl vane is provided, the radially-outer flow path region and the radially-inner flow-path region of the axial flow path of the combustion burner are communicating with each other without being partitioned. In this way, the mixing of the gas flowing through the radially-outer flow path region and the gas flowing through the radially-inner flow path region is promoted. Thus, the concentration distribution of the fuel supplied to the axial flow path is equalized in the radial direction of the combustion burner.

A combustor according to at least one embodiment of the present invention comprises: the combustion burner according to any one of the above embodiments; and a combustor liner for forming a flow path for guiding combustion gas from the combustion burner.

A gas turbine according to at least one embodiment of the present invention comprises: a compressor for generating compressed air; the combustor configured to combust fuel with the compressed air from the compressor to generate combustion gas; and a turbine configured to be driven by the combustion gas from the combustor.

Advantageous Effects

According to at least one embodiment of the present invention, it is possible to increase the mean axial-flow velocity in the radially-inner flow path region of the axial flow path and to improve the flashback-resistant property effectively.

DETAILED DESCRIPTION

Embodiments of the present invention will now be described in detail with reference to the accompanying drawings. It is intended, however, that unless particularly specified, dimensions, materials, shapes, relative positions and the like of components described in the embodiments shall be interpreted as illustrative only and not intended to limit the scope of the present invention.

Figure 1:
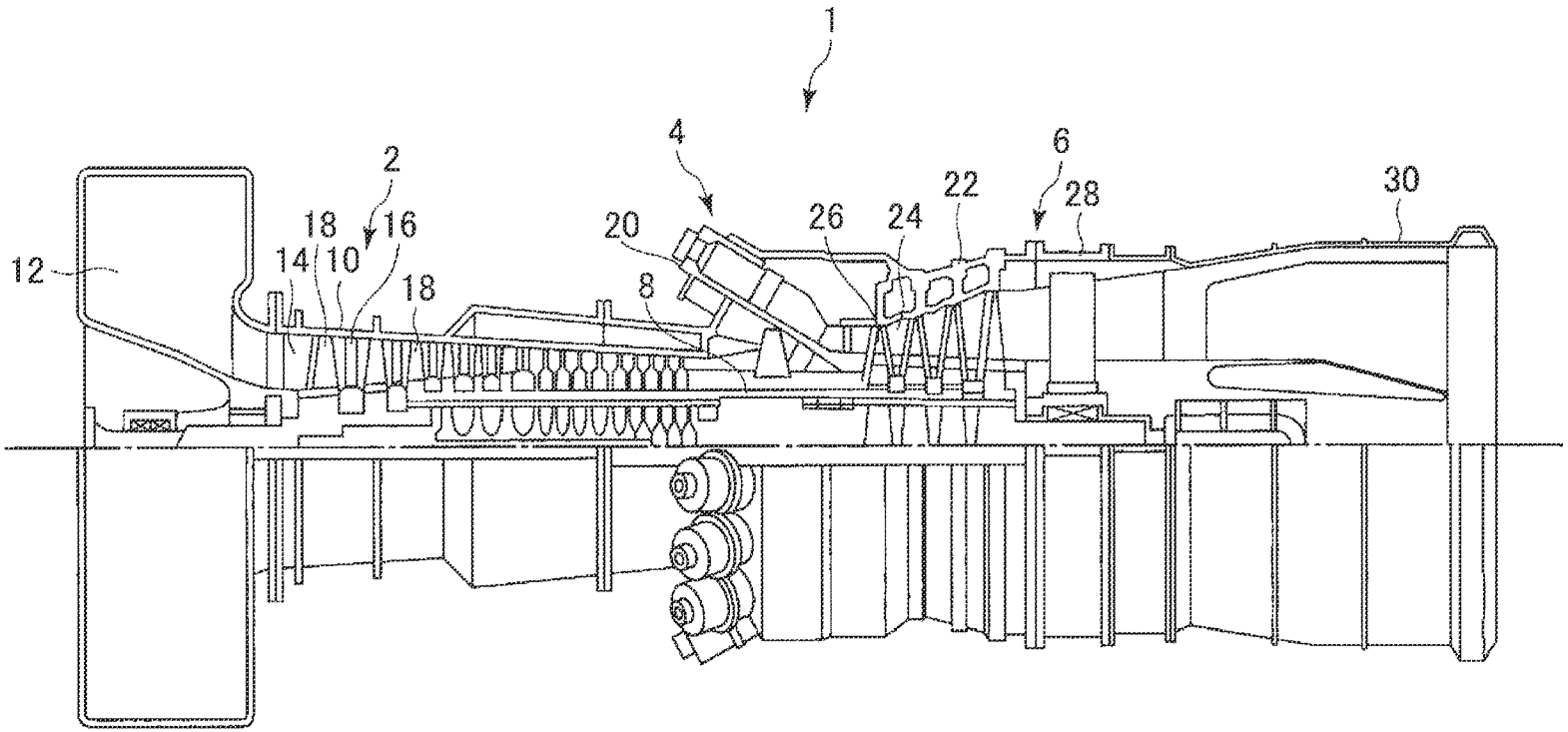
FIG. 1 is a schematic configuration diagram of a gas turbine according to one embodiment.

First, with reference to FIG. 1, a gas turbine to which a combustion burner and a combustor according to the present invention are to be applied will be described. FIG. 1 is a schematic configuration diagram of a gas turbine 1 according to one embodiment.

As illustrated in FIG. 1, the gas turbine 1 according to one embodiment includes a compressor 2 for producing compressed air that serves as an oxidant, a combustor 4 for generating combustion gas using the compressed air and fuel, and a turbine 6 configured to be driven to rotate by the combustion gas. In the case of the gas turbine 1 for power generation, a generator (not illustrated) is connected to the turbine 6, so that rotational energy of the turbine 6 generates electric power.

The configuration example of each component in the gas turbine 1 will be described specifically.

The compressor 2 includes a compressor casing 10, an air inlet 12 for sucking in air, disposed on an inlet side of the compressor casing 10, a rotor 8 disposed so as to penetrate through both of the compressor casing 10 and the turbine casing 22 described below, and a variety of vanes disposed in the compressor casing 10. The variety of vanes includes an inlet guide vane 14 disposed adjacent to the air inlet 12, a plurality of stator vanes 16 fixed to the compressor casing 10, and a plurality of rotor vanes 18 implanted on the rotor 8 so as to be arranged alternately with the stator vanes 16. The compressor 2 may include other constituent elements not illustrated in the drawings, such as an extraction chamber. In the above compressor 2, the air sucked in from the air inlet 12 flows through the plurality of stator vanes 16 and the plurality of rotor vanes 18 to be compressed to turn into compressed air having a high temperature and a high pressure. The compressed air having a high temperature and a high pressure is sent to the combustor 4 of a latter stage from the compressor 2.

The combustor 4 is disposed in a casing 20. As illustrated in FIG. 1, a plurality of combustors 4 may be disposed in an annular shape centered at the rotor 8 inside the casing 20. The combustor 4 is supplied with fuel and the compressed air produced in the compressor 2, and generates combustion gas that serves as a working fluid of the turbine 6 by combusting the fuel. The combustion gas is sent to the turbine 6 at a latter stage from the combustor 4. The configuration example of the combustor 4 will be described later in detail.

The turbine 6 includes a turbine casing 22 and a variety of vanes disposed inside the turbine casing 22. The variety of vanes includes a plurality of stator vanes 24 fixed to the turbine casing 22 and a plurality of rotor vanes 26 implanted on the rotor 8 so as to be arranged alternately with the stator vanes 24. The turbine 6 may include other constituent elements not illustrated in the drawings, such as outlet guide vanes and the like. In the turbine 6, the rotor 8 is driven to rotate as the combustion gas passes through the plurality of stator vanes 24 and the plurality of rotor vanes 26. In this way, the generator connected to the rotor 8 is driven.

An exhaust chamber 30 is connected to the downstream side of the turbine casing 22 via an exhaust casing 28. The combustion gas having driven the turbine 6 is discharged outside via the exhaust casing 28 and the exhaust chamber 30.

Figure 2:
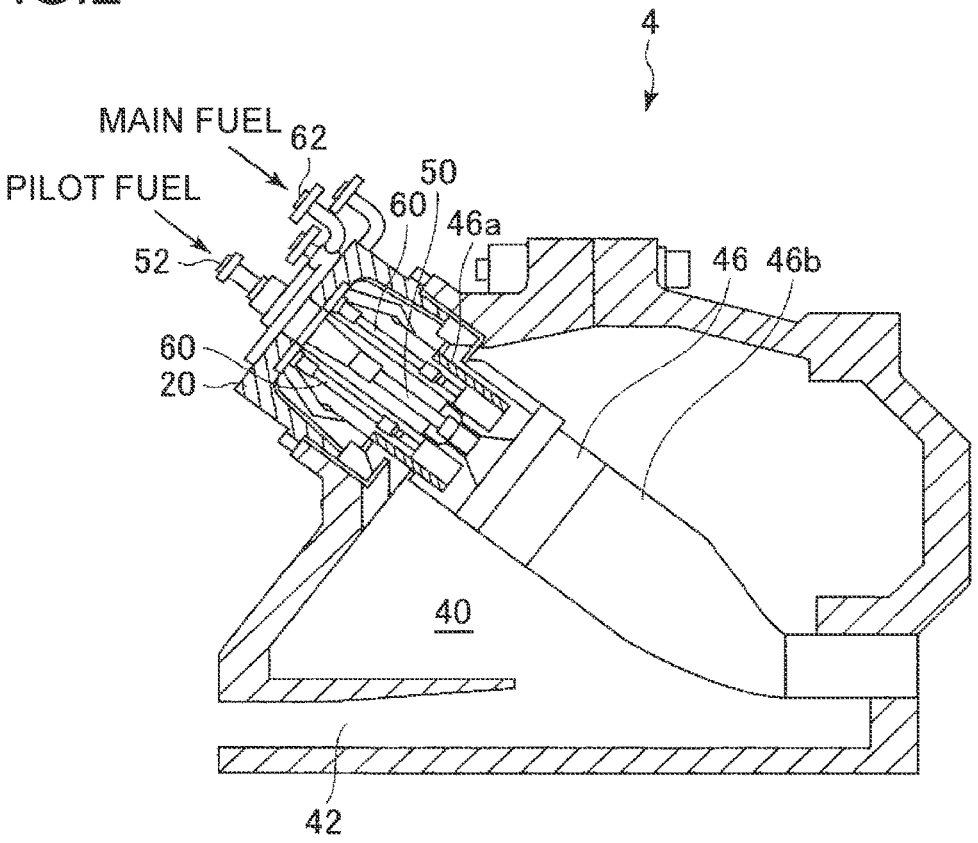
FIG. 2 is a cross-sectional view of a combustor according to one embodiment.
Figure 3:
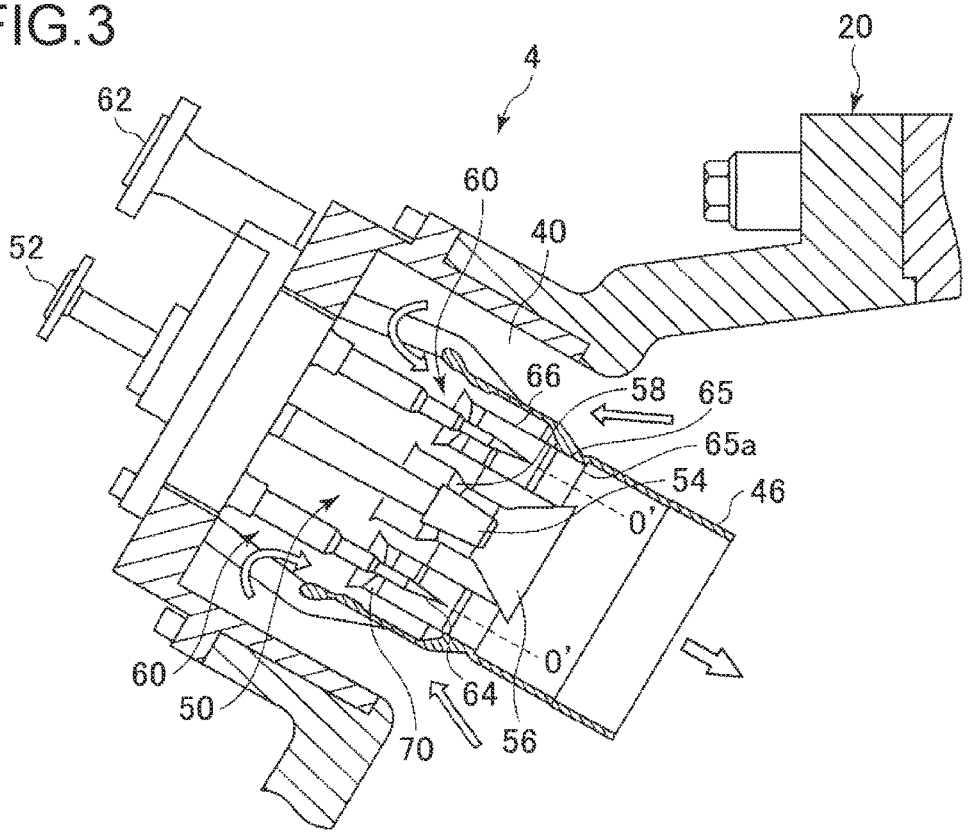
FIG. 3 is a cross-sectional view of a part of a combustor according to one embodiment.

Next, with reference to FIGS. 2 and 3, the specific configuration of the combustor 4 according to one embodiment will be described. FIG. 2 is a cross-sectional view of a combustor according to one embodiment. FIG. 3 is a cross-sectional view of a part of a combustor according to one embodiment.

As illustrated in FIGS. 2 and 3, a plurality of combustors 4 according to one embodiment is disposed in an annular shape centered at the rotor 8 (see FIG. 1). Each combustor 4 includes a combustor liner 46 disposed in a combustor casing 40 defined by the casing 20, a pilot combustion burner 50 disposed in the combustor liner 46, and a plurality of premix combustion burners (main combustion burners) 60 disposed in the combustor liner 46. The combustor 4 may include other constituent elements such as a bypass line (not illustrated) for causing the combustion gas to bypass.

For instance, the combustor liner 46 includes a combustor basket 46*a* disposed around the pilot combustion burner 50 and the plurality of premix combustion burners 60, and a transition piece 46*b* connected to a distal end of the combustor basket 46*a*.

The pilot combustion burner 50 is disposed along the center axis of the combustor liner 46. The plurality of premix combustion burners 60 is arranged at a distance from one another so as to surround the pilot combustion burner 50.

The pilot combustion burner 50 includes a pilot nozzle (nozzle) 54 connected to a fuel port 52, a pilot cone 56 disposed so as to surround the pilot nozzle 54, and a swirler 58 disposed on the outer circumference of the pilot nozzle 54.

The premix combustion burner 60 includes a main nozzle (nozzle) 64 connected to a fuel port 62, a burner cylinder 66 disposed so as to surround the nozzle 64, an extension tube 65 for connecting the burner cylinder 66 and the combustor liner 46 (e.g. combustor basket 46*a*), and a swirler 70 disposed on the outer circumference of the nozzle 64. The specific configuration of the premix combustion burner 60 will be described later.

As illustrated in FIG. 3, the extension tube 65 extends from an upstream end surface connected to the burner cylinder 66 to a downstream end surface (extension-tube outlet 65*a*). Further, FIG. 3 illustrates a flow-path center axis O' passing through the center position of the extension-tube outlet 65*a*.

In the combustor 4 having the above configuration, the compressed air having a high temperature and a high pressure produced in the compressor 2 is supplied into the combustor casing 40 from a casing inlet 42, and then flows into the burner cylinder 66 from the combustor casing 40. The compressed air and fuel supplied from the fuel port 62 are premixed in the burner cylinder 66. At this time, the premixed air mainly forms a swirl flow by the swirler 70, and flows into the combustor liner 46. Further, the compressed air and fuel injected from the pilot combustion burner 50 via the fuel port 52 are mixed in the combustor liner 46, and ignited by a pilot light (not illustrated) to be combusted, thereby generating combustion gas. At this time, a part of the combustion gas diffuses to the surroundings with flames, which ignites the premixed air flowing into the combustor liner 46 from each premix combustion burner 60 to cause combustion. Specifically, the pilot flame due to the pilot fuel injected from the pilot combustion burner 50 makes it possible to secure flames for performing stable combustion of premixed air (premixed fuel) from the premix combustion burners 60. At this time, a combustion region is formed, for instance, in the combustor basket 46*a*.

Now, the configuration of the combustion burner according to the present embodiment will be described in detail referring to the above described premix combustion burner 60 as an example.

The combustion burner according to the present embodiment is not limited to the premix combustion burner 60, and the configuration of the present embodiment can be applied to a combustion burner of any type as long as the combustion burner includes a swirler (swirl vane) in an axial flow path around a nozzle. For instance, the combustion burner may be a combustion burner which mainly performs diffusive combustion like the pilot combustion burner 50 disposed in the combustors 4 of the gas turbine 1, or may be a combustion burner disposed in a device other than the gas turbine 1.

Figure 4:
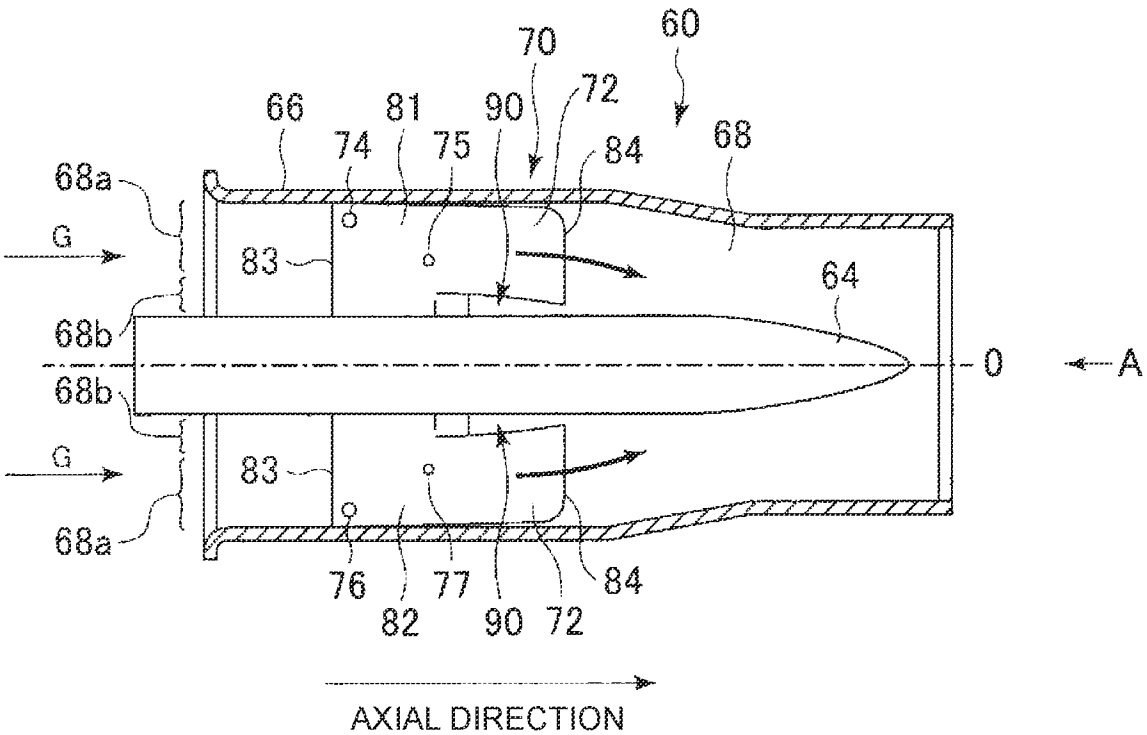
FIG. 4 is a cross-sectional view of a combustion burner according to one embodiment.
Figure 5:
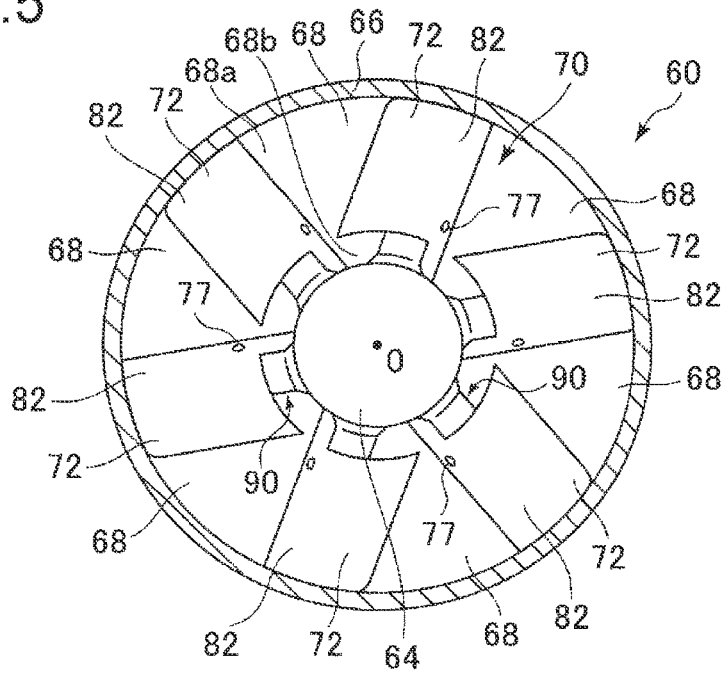
FIG. 5 is a view on arrow A of the combustion burner illustrated in FIG. 4.

FIGS. 4 and 5 illustrate the schematic configuration of the combustion burner (premix combustion burner) 60 according to one embodiment. FIG. 4 is a cross-sectional view along the axial direction of the nozzle of the combustion burner 60 according to one embodiment, and FIG. 5 is a view on arrow A of the combustion burner illustrated in FIG. 4.

The combustion burner 60 according to one embodiment includes a nozzle (fuel nozzle) 64, a burner cylinder 66, and a swirler 70.

The nozzle 64 is connected to the fuel port 62 (see FIGS. 2 and 3) as described above, and fuel is supplied from the fuel port 62. The fuel may be gas or liquid, and the type is not particularly limited. Further, the pilot nozzle 54 and the nozzle 64 may be supplied with different types of fuel. For instance, the pilot nozzle 54 may be supplied with oil fuel while the nozzle 64 is supplied with gas fuel such as natural gas fuel.

The burner cylinder 66 is disposed concentrically with the nozzle 64 and so as to surround the nozzle 64. Specifically, the axis of the burner cylinder 66 substantially coincides with the axis O of the nozzle 64, and the diameter of the burner cylinder 66 is larger than the diameter of the nozzle 64.

An axial flow path 68 of an annular shape is formed along the axial direction of the nozzle 64 between the outer circumferential surface of the nozzle 64 and the inner circumferential surface of the burner cylinder 66. Gas G such as compressed air flows through the axial flow path 68 from the upstream side (left side in FIG. 4) toward the downstream side (right side in FIG. 4).

The swirler 70 is configured to swirl gas flowing through the axial flow path 68, and includes at least one swirl vane 72. In an example illustrated in FIGS. 4 and 5, the swirler 70 includes six swirl vanes 72 disposed radially from the nozzle 64 at the center. In FIG. 4, as a matter of convenience, the drawings illustrate only two swirl vanes 72 disposed at the positions of 0 and 180 angular degrees along the circumferential direction (in the situation illustrated in FIG. 4, four swirl vanes 72 in total could be seen in reality).

The swirl vanes 72 are disposed around the nozzle 64 in the axial flow path 68 extending in the axial direction (direction of the axis O) of the nozzle 64, and configured to apply a swirl force to the gas flowing through the axial flow path 68. Each swirl vane 72 has a pressure surface 81, a suction surface 82, a leading edge 83 being an upstream edge in the flow direction of the gas (the axial direction of the nozzle 64), and a trailing edge 84 being a downstream edge in the flow direction of the gas (the axial direction of the nozzle 64).

A plurality of injection apertures 74, 77 is formed on the swirl vanes 72. In the present embodiment, as an example, two injection apertures 74, 75 are formed on the pressure surface 81 of the swirl vane 72, and two injection apertures 76, 77 are formed on the suction surface 82 of the swirl vane 72. The plurality of injection apertures 74 to 77 may be disposed on the side of the leading edge 83 of the swirl vane 72. Further, two injection apertures 74 and 75, or two injection apertures 76 and 77, that open on the same surface, may be disposed offset from each other with respect to the axial direction or the radial direction of the nozzle 64. The injection apertures 74 to 77 communicate with each other inside the swirl vane 72, and also to a fuel path in the nozzle 64. Fuel injected from the injection apertures 74 to 77 is mixed with gas (e.g. compressed air serving as an oxidant) to become premixed gas (fuel gas), and is sent to the combustor liner 46 to be combusted.

Further, a cutout 90 is formed on the trailing edge 84 of each swirl vane 72, in a region 68*b* at the radially inner side within the axial flow path 68 (hereinafter, referred to as a radially-inner flow path region). Specifically, the swirl vanes 72 are configured to form mainly a swirl flow in a region at the radially outer side within the axial flow path 68 (hereinafter, referred to as a radially-outer flow path region), and form mainly an axial flow in the radially-inner flow path region 68*b* by the cutouts 90. The specific configuration of the cutouts 90 will be described later.

Figure 6:
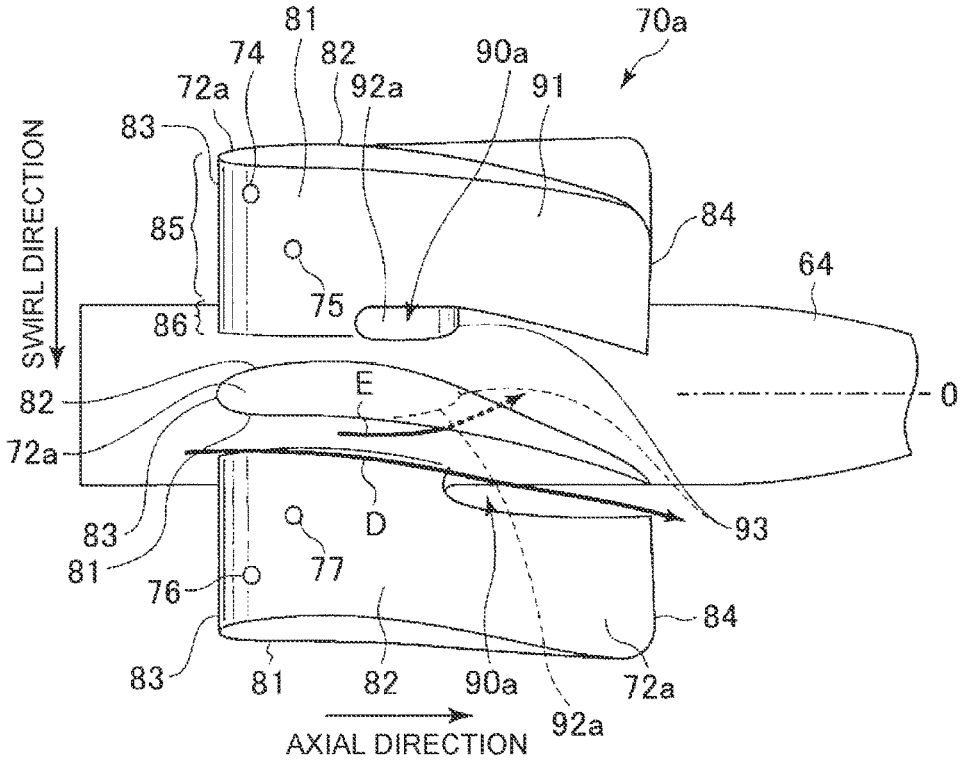
FIG. 6 is a side view of a nozzle and a swirler according to one embodiment.
Figure 7:
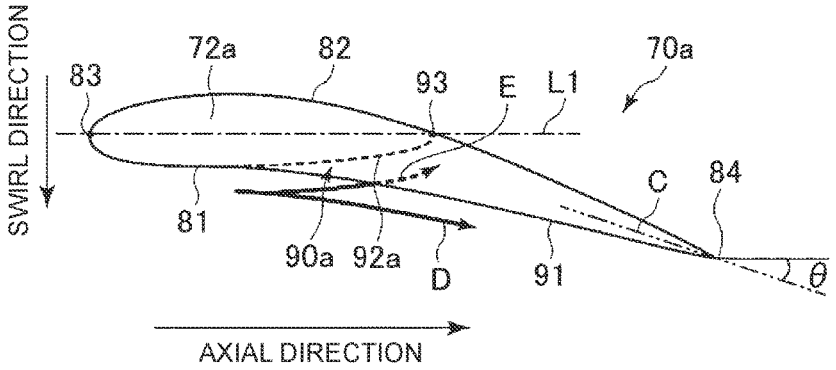
FIG. 7 is a planar view of a configuration example of a swirler.
Figure 8:
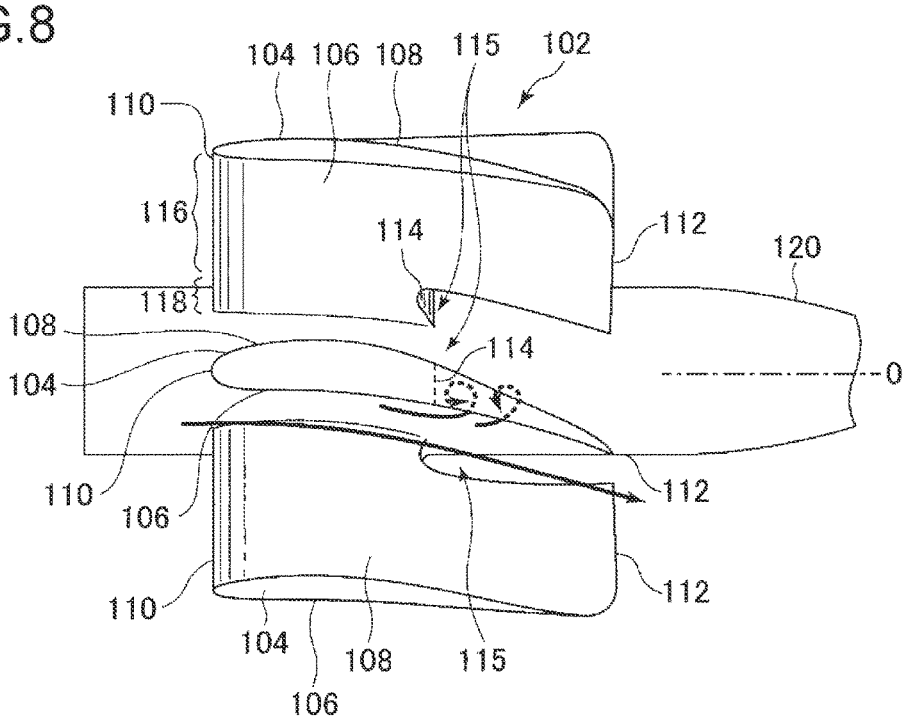
FIG. 8 is a side view of a nozzle and a swirler according to a comparison example.

With reference to FIGS. 6 to 17, the configuration example of the swirl vanes 72 will be described specifically, except FIG. 8 illustrates a swirl vane of a comparative example. In FIGS. 6 to 17, the same component is indicated by the same reference numeral.

The swirl vanes 72*a* to 72*d* illustrated in FIGS. 6 to 17 include a tip portion 85 for swirling gas that flows through the radially-outer flow path region 68*a* (see FIG. 4) in a swirl direction, and a root portion 86 disposed on the inner side in the radial direction of the nozzle 64 as seen from the tip portion 85, i.e., disposed in the radially-inner flow path region 68*b* (see FIG. 4), the trailing edge 93 of the root portion 86 being defined by cutouts 90*a* to 90*d*.

On the pressure surface 81 of the tip portion 85 of the swirl vanes 72*a* to 72*d*, a curved surface 91 curving from the upstream side toward the downstream side is formed so as to apply a swirling force mainly to the gas flowing through the axial flow path 68. Specifically, the pressure surface 81 of the tip portion 85 of the swirl vanes 72*a* to 72*d* is configured such that the angle θ formed between a camber line C (see FIG. 7) of the pressure surface 81 and the flow direction of the gas (i.e. the axial direction of the nozzle 64) gradually increases from the upstream side toward the downstream side. The angle θ formed between the camber line C and the flow direction of the fluid may be within a range of from 20° to 30° in a downstream region of the tip portion 85 of the swirl vanes 72*a* to 72*d*. Due to the curved surface 91 of the pressure surface 81 of the tip portion 85 configured as described above, the gas flowing through the radially-outer flow path region 68*a* forms into a swirl flow D swirling in a swirl direction.

On the other hand, a downstream region of the pressure surface 81 of the root portion 86 of the swirl vanes 72*a* to 72*d* is defined by the cutouts 90*a* to 90*d* as curved surfaces 92*a* to 92*d* which curve opposite to a swirl direction toward the trailing edge 93 of the root portion 86. That is, the downstream region of the root portion 86 is curved in a direction opposite to the tip portion 85. The curved surfaces 92*a* to 92*d* of the pressure surface 81 of the root portion 86 configured as described above form gas flows E, F in the radially inner region.

The trailing edge 93 of the root portion 86 of the swirl vanes 72*a* to 72*d* may be disposed on the upstream side in the axial direction and on the upstream side in the swirl direction as compared to the trailing edge of the tip portion 85.

Further, at least in a range in the axial direction in which the swirl vanes 72*a* to 72*d* are provided, the radially-outer flow path region 68*a* and the radially-inner flow path region 68*b* of the axial flow path 68 are communicating with each other without being partitioned. The range in the axial direction refers to the range along the axis O of the nozzle 64.

That is, as illustrated in the above described FIG. 5, a plurality of axial flow paths 68 is formed in a radial fashion radially outside the nozzle 64 centered at the axis O, and between adjacent swirl vanes 72 (72*a* to 72*d*) as seen from the tip end of the nozzle 64. In each of the axial flow paths 68, the radially-outer flow path region 68*a* and the radially-inner flow path region 68*b* are in communication so that a single space is formed in the radial direction of the nozzle 64. The axial flow path 68 may include no portion between the radially-outer flow path region 68*a* and the radially-inner flow path region 68*b*, the radially-outer flow path region 68*a* and the radially-inside flow path region 68*b* communicating with each other (as illustrated in the drawings), or may include another portion (not illustrated) between the radially-outer flow path region 68*a* and the radially-inside flow path region 68*b*, the radially-outer flow path region 68*a* and the radially-inside flow path region 68*b* partially communicating with each other.

With the above configuration, at the tip portion 85 of the swirl vanes 72*a* to 72*d*, the gas flowing through the radially-outer flow path region 68*a* of the axial flow path 68 is swirled, which makes it possible to promote premix of the gas and the fuel supplied to the axial flow path 68 by the swirl flow D formed by the tip portion 85. On the other hand, the cutouts 90*a* to 90*d* are formed on the downstream side of the root portions 86 of the swirl vanes 72*a* to 72*d*, and the cutouts 90*a* to 90*d* form the curved surfaces 92*a* to 92*d* curving in a direction opposite to the swirl direction toward the trailing edge 93 of the root portions 86 in the downstream region of the pressure surface 81 of the root portions 86. Thus, in the radially-inner flow path region 68*b* of the axial flow path 68, the gas is attracted toward the curved surfaces 92*a* to 92*d* by the Coanda effect to be rectified in a direction opposite to the swirl direction. As a result, the swirl component applied to the gas in the upstream region of the pressure surface 81 of the root portion 86 weakens in the downstream region of the pressure surface 81 of the root portion 86, which increases the mean axial-flow velocity in the radially-inner flow path region 68*b* to improve the flashback-resistant property. The gas further flows along the curved surfaces 92*a* to 92*d* in the downstream region of the pressure surface 81 of the root portion 86, which makes it possible to suppress occurrence of turbulence due to separation of the flow at the downstream side of the cutouts 90*a* to 90*d*, and to prevent the axial-flow velocity from becoming unstable due to a negative fluctuation component caused by such turbulence. Thus, it is possible to suppress a fluctuation in the axial-flow velocity in the radially-inner flow path region 68*b* and to improve the flashback-resistant property effectively.

Further, at least in a range in the axial direction in which the swirl vanes 72*a* to 72*d* are provided, the radially-outer flow path region 68*a* and the radially-inner flow path region 68*b* of the axial flow path 68 of the combustion burner 60 are communicating with each other without being partitioned. In this way, the mixing of the gas flowing through the radially-outer flow path region 68*a* and the gas flowing through the radially-inner flow path region 68*b* is promoted. Thus, the concentration distribution of the fuel supplied to the axial flow path 68 is equalized in the radial direction of the combustion burner 60.

Figure 9:
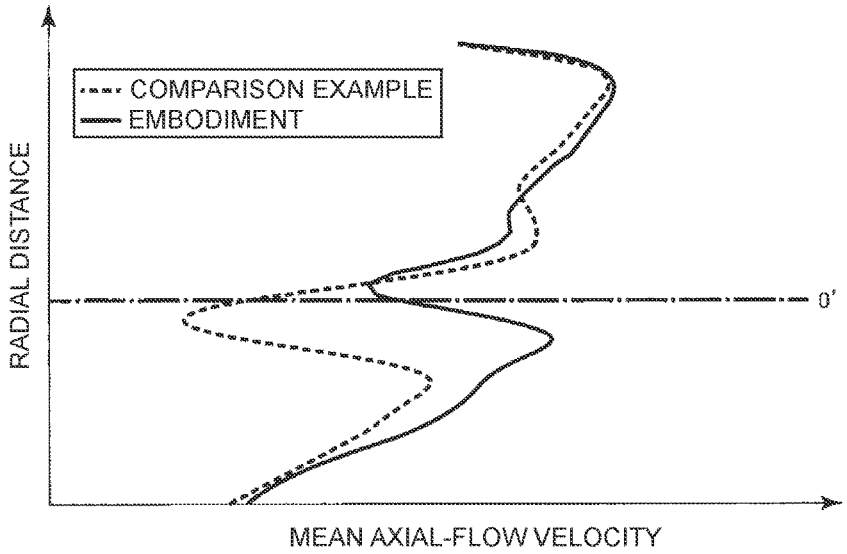
FIG. 9 is a graph showing a relationship between a mean axial-flow velocity and a radial distance at an outlet of an extension tube of the embodiment and the comparison example.

Now, with reference to FIG. 9, the flashback-resistant property of the combustion burner of the present embodiment will be compared to that of the comparison example. FIG. 9 is a graph showing a relationship between a mean axial-flow velocity and a radial distance at an outlet of an extension tube of the embodiment and the comparison example. In the drawing, the combustion burner of the embodiment includes the nozzle 64 and the swirler 70*a* illustrated FIGS. 6 and 7, and the combustion burner of the comparison example includes the nozzle 120 and the swirler 102 illustrated in FIG. 8, and the mean axial-flow velocity of each case is shown.

In the comparison example illustrated in FIG. 8, the swirler 102 includes a plurality of swirler vanes 104 disposed in a radial fashion around the nozzle 120. Each swirl vane 104 includes a tip portion 116 at the radially outer side and a root portion 118 at the radially inner side. Further, the swirl vane 104 includes a pressure surface 106, a suction surface 108, a leading edge 110, and a trailing edge 112. In the above configuration (e.g. the number and arrangement of the swirl vanes), the comparison example is substantially the same as the configuration of the present embodiment. Further, the swirl vane 104 includes a cutout 115 having a configuration different from that of the present embodiment. The cutout 115 is formed on a downstream region of the root portion 118 of the swirl vane 104, and the cutout 115 defines the trailing edge 114 of the root portion 118 in a planar shape orthogonal to the axis O of the nozzle 120. That is, the trailing edge 114 of the root portion 118 is formed by an end surface orthogonal to the axis O of the nozzle 120 between the pressure surface 106 and the suction surface 108 of the root portion 118.

As described above, according to the findings of the present inventors, flashback that may occur in a combustion burner (vortex-core flashback, in particular) is likely to occur when the mean axial-flow velocity of the combustion burner decreases extremely in the radially-inner flow path region 68*b*. Thus, for each of the combustion burner in the present embodiment and the combustion burner in the comparison example, computational fluid dynamics (CFD) is used to calculate the mean axial-flow velocity with respect to the radial distance of the nozzles 64, 120. The mean axial-flow velocity mentioned here is the axial-flow velocity at the outlet of the extension tube at the downstream side of the nozzles 64, 120 averaged over a predetermined period.

As a result, in the combustion burner of the comparison example, the mean axial-flow velocity decreases more considerably in the radially-inner flow path region than in the radially-outer flow path region, and the mean axial-flow velocity at the center axis O' of the flow path decreases in the mean axial-flow velocity distribution (dotted line in FIG. 9) at the outlet of the extension tube. The reason is that the trailing edge 114 of the root portion 118 of the swirl vane 104 in the comparison example is formed by an end surface that intersects orthogonally with the axis O of the nozzle 120, and thus the gas having flown along the upstream region of the root portion 118 separates from the root portion 118 at the trailing edge 114, and turbulence occurs at the downstream side of the cutout 115.

On the other hand, in the combustion burner in the present embodiment, the mean axial-flow velocity in the radially-inner flow path region 68*b* is higher than that in the comparison example, and thus a decrease in the mean axial-flow velocity at the center axis O' of the flow path is suppressed in the mean axial-flow velocity distribution (solid line in FIG. 9) at the outlet 65*a* of the extension tube. Specifically, according to the present embodiment, the mean axial-flow velocity distribution at the outlet 65*a* of the extension tube is uniform as compared to that in the comparison example. This is because, as described above, the gas is rectified to a direction opposite from the swirl direction by the cutout 90*a* in the radially-inner flow path region 68*b*, so that the swirl component applied to the gas in the upstream region of the pressure surface 81 of the root portion 86 weakens in the downstream region of the pressure surface 81 of the root portion 86, which increases the mean axial-flow velocity in the radially-inner flow path region 68*b*.

As described above, according to the present embodiment, it is possible to suppress a fluctuation in the axial-flow velocity in the radially-inner flow path region 68*b* and to improve the flashback-resistant property.

In addition to the basic configuration of the combustion burner according to the present embodiment described above, the combustion burner of the present embodiment may further include any one of the following configurations. Further, it will be understood that two or more of the configurations illustrated in different drawings may be combined in one embodiment.

FIG. 6 is a side view of the nozzle 64 and the swirler 70*a* according to one embodiment. FIG. 7 is a planar view of a configuration example of the swirler 70*a*.

As illustrated in FIGS. 6 and 7, in each swirl vane 72*a*, the airfoil (a cross-sectional shape taken along a plane orthogonal to the radial direction of the nozzle 64; the same apply hereinafter) of the root portion 86 has the same airfoil as that of the tip portion 85 in the upstream region, while having such a shape that a portion corresponding to the cutout 90*a* is cut out from the airfoil of the tip portion 85 in the downstream region. This configuration can be suitably used in a two-dimensional airfoil.

In this way, formed is a blade member having a substantially constant airfoil over the entire length of the blade height of the swirl vane 72*a*, with the cutout 90*a* disposed in the downstream region of the root portion 86 of the blade member. As a result, it is possible to produce the swirl vane 72*a* having a curved surface curving in a direction opposite to the swirl direction at the root portion 86.

As illustrated in FIG. 7, the trailing edge 93 of the root portion 86 of the swirl vane 72*a* may be disposed at the same position as the leading edge 83 of the root portion 86, in the circumferential direction of the nozzle 64. In other words, the trailing edge 93 of the root portion 86 is disposed on a straight line $L_1$ that extends along the axis O of the nozzle 64 and passes through the leading edge 83 of the swirl vane 72*a*.

According to the above embodiment, the trailing edge 93 of the root portion 86 of the swirl vane 72*a* returns to the same position as that of the leading edge 83 in the circumferential direction due to the curve curving in a direction opposite to the swirl direction. Thus, as compared to a case in which the trailing edge 93 of the root portion 86 of the swirl vane 72*a* is offset toward the downstream side in the swirl direction from the leading edge 83, it is possible to mitigate the swirl component of the flow in the radially-inner flow path region 68*b* sufficiently and increase the mean axial-flow velocity securely.

Further, the airfoil of the root portion 86 of the swirl vane 72*a* may have a shape that is line-symmetric with respect to the straight line $L_1$ passing through the trailing edge 93 and parallel to the axial direction, at least at the side of the trailing edge 93. For instance, the airfoil of the root portion 86 of the swirl vane 72*a* may have an ellipse shape, a teardrop shape, an oval shape, or the like. In addition to the above configuration, the airfoil of the root portion 86 may have a line-symmetric shape with respect to a straight line orthogonal to the axial direction at the sides of the leading edge 83 and the trailing edge 93 (e.g. an ellipse shape or an oval shape).

In this way, it is possible to increase the mean axial-flow velocity in the radially-inner flow path region 68*b* and to simplify the cross-sectional shape of the root portion 86. In this case, it is possible to improve the manufacturability of the swirl vane 72*a*.

Figure 10:
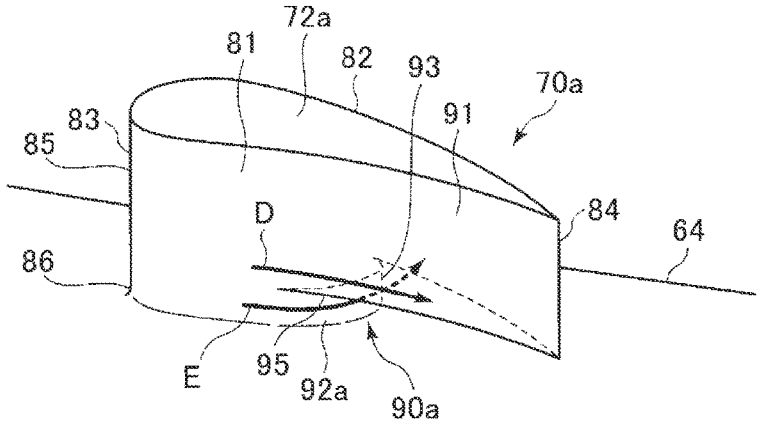
FIG. 10 is a perspective view of a swirler according to one embodiment.

FIG. 10 is a perspective view of a swirler according to one embodiment. As illustrated in FIG. 10, in one embodiment, the pressure surface 81 of the tip portion 85 of the swirl vane 72*a* has the curved surface 91 curving in the swirl direction toward the trailing edge 84, and the pressure surface 81 of the swirl vane 72*a* has a stepped portion 95 between the curved surface 91 of the tip portion 85 and the curved surface 92*a* of the root portion 86.

According to the above embodiment, at the stepped portion 95 formed on the pressure surface 81 of the swirl vane 72*a*, a shear layer is formed between a flow D in the swirl direction along the curved surface 91 of the tip portion 85 and a flow E opposite to the swirl direction along the curved surface 92*a* of the root portion 86. A swirl is generated at the shear layer, and the mixing of the gas flowing through the radially-outer flow path region 68*a* and the gas flowing through the radially-inner flow path region 68*b* is promoted. In this way, in a case where fuel is supplied at the upstream of the swirl vane 72*a*, it is possible to further equalize the distribution of the fuel concentration in the radial direction of the combustion burner 60.

Figure 11:
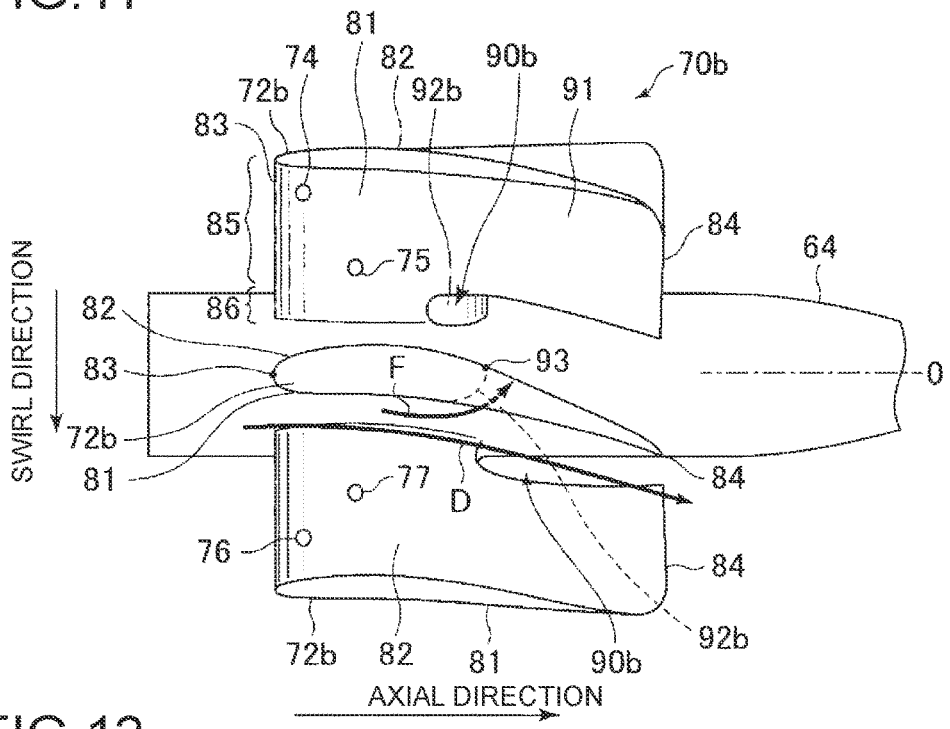
FIG. 11 is a side view of a nozzle and a swirler according to another embodiment.
Figure 12:
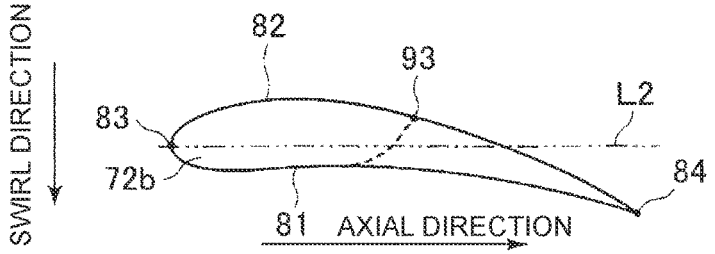
FIG. 12 is a planar view of a configuration example of a swirl vane illustrated in FIG. 11.
Figure 13:
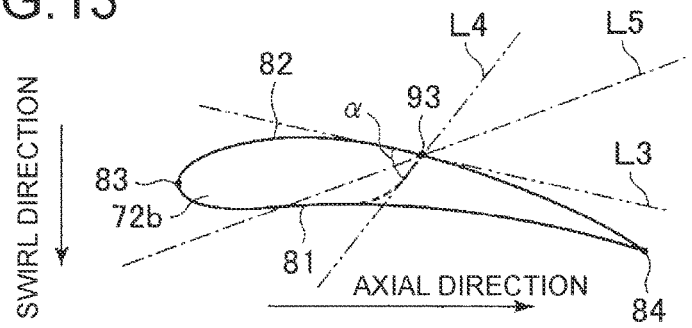
FIG. 13 is a planar view of another configuration example of a swirl vane illustrated in FIG. 11.

FIG. 11 is a side view of a nozzle and a swirler according to another embodiment. FIG. 12 is a planar view of a configuration example of a swirl vane illustrated in FIG. 11. FIG. 13 is a planar view of another configuration example of a swirl vane illustrated in FIG. 11.

As illustrated in FIG. 11, in the swirler 70*b* of another embodiment, the curved surface 92*b* of the root portion 86 may be configured to swirl gas that flows through the radially-inner flow path region 68*b* of the axial flow path in a direction opposite to the swirl direction. In this way, the gas swirls in the radially-inner flow path region 68*b* in a direction opposite to the swirl direction of the radially-outer flow path region 68*a*, which makes it possible to mitigate the swirl component in the radially-inner flow path region 68*b* even more effectively.

As illustrated in FIGS. 11 and 12, in another embodiment, the trailing edge 93 of the root portion 86 of the swirl vane 72*b* may be disposed opposite to the trailing edge 84 of the tip portion 85 across a straight line $L_2$ that passes through the leading edge 83 and extends parallel to the axial direction, in the circumferential direction of the nozzle 64. In this way, the trailing edge 93 of the root portion 86 is positioned at the upstream side of the leading edge 83 in the swirl direction, which makes it possible to orient the flow in the radially-inner flow path region 68*b* (see FIG. 5) securely in a direction opposite to the swirl direction, and to reduce the swirl component in the radially-inner flow path region 68*b* even more effectively. As a result, it is possible to increase the mean axial-flow velocity in the radially-inner flow path region 68*b* securely.

As illustrated in FIGS. 11 and 13, in another embodiment, the bisector $L_5$ of an angle $\alpha$ formed by a tangent $L_3$ of the suction surface 82 passing through the trailing edge 93 of the root portion 86 of the swirl vane 72*b* and a tangent $L_4$ of the pressure surface 81 passing through the trailing edge 93 of the root portion 86 may be oblique to the axial direction in a direction opposite to the swirl direction at the downstream side of the trailing edge 93 of the root portion 86.

In the present embodiment, while the gas is swirling in the swirl direction in the radially-outer flow path region 68*a* (see FIG. 5), the gas flows in a direction opposite to the swirl direction in the radially-inner flow path region 68*b* (see FIG. 5). In this way, it is possible to mitigate the swirl component in the radially-inner flow path region 68*b* even more effectively.

Figure 14:
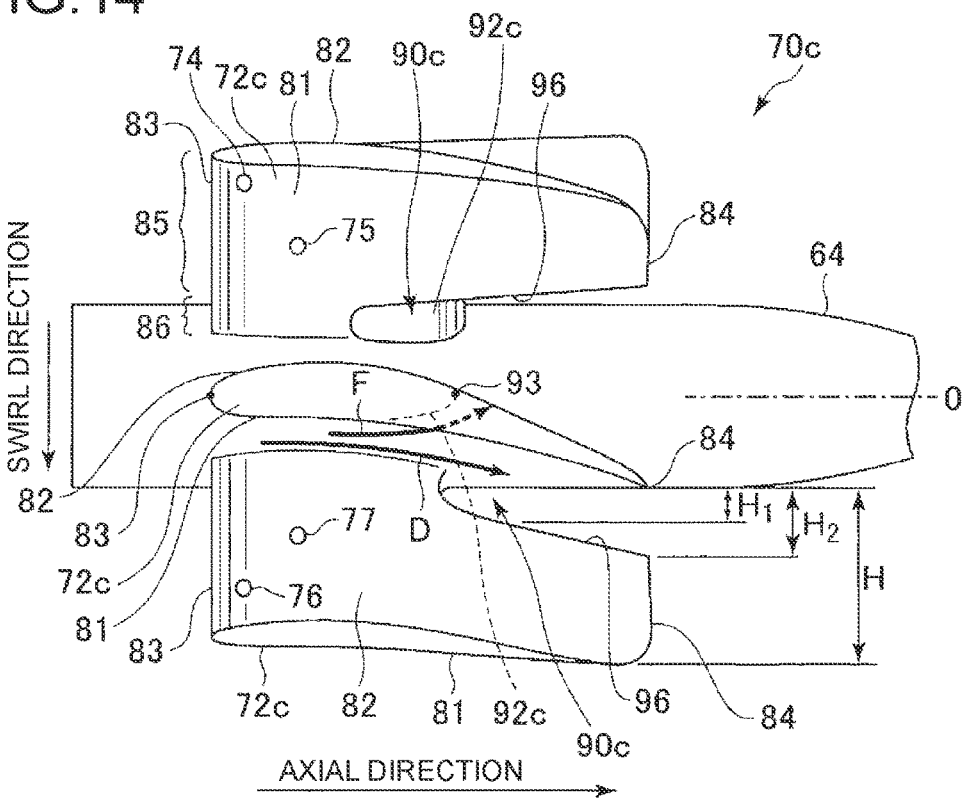
FIG. 14 is a side view of a nozzle and a swirler according to another embodiment.

FIG. 14 is a side view of a nozzle and a swirler according to another embodiment. As illustrated in FIG. 14, in another embodiment, the tip portion 85 of the swirl vane 72*c* is disposed on the outer side, in the radial direction, of a cutout space formed by the cutout 90*c* in the downstream region of the tip portion 85, so as to have a cutout-space forming surface 96 that faces the cutout space. The cutout-space forming surface 96 has a shape such that a width of the cutout space increases in the radial direction toward the downstream side. Specifically, with regard to the width of the cutout space in the radial direction, i.e., a distance between the cutout-space forming surface 96 and the outer circumferential surface of the nozzle 64, the distance $H_2$ at the downstream side (e.g. at the position of the trailing edge 84 of the tip portion 85 in the axial direction) is greater than the distance $H_1$ at the upstream side of the cutout 90*c* (e.g. at the position of the trailing edge 93 of the root portion 86 in the axial direction). Further, the cutout-space forming surface 96 may be formed so as to gradually increase from the distance $H_1$ at the upstream side toward the distance $H_2$ at the downstream side. Alternatively, the cutout-space forming surface 96 may be a flat surface that extends linearly and oblique to the axial direction so that the width of the cutout space in the radial direction increases toward the downstream side. Further, from the distance $H_1$ at the upstream side toward the distance $H_2$ at the downstream side, the distance may be from 3 to 20% of the height H of the swirl vane 72*c* in the radial direction. For instance, the distance $H_1$ at the upstream side being a lower limit is 3% or more and the distance $H_2$ at the downstream side being an upper limit is 20% or less.

According to the above embodiment, it is possible to secure a large width where the flow mainly including the swirl flow in the radially-outer flow path region 68*a* and the flow mainly including the axial flow passing through the cutout 90*c* in the radially-inner flow path region 68*b* are to be mixed with each other, which makes it possible to equalize the flow-velocity distribution at the downstream side of the axial flow path 68. The more uniform the flow-velocity distribution at the flame-holding position is, the closer the shape of the flame surface gets to a flat shape, and the smaller a baroclinic torque that causes the flame surface to flow backward to the upstream side becomes. Thus, with the flow-velocity distribution at the downstream side of the axial flow path 68 being uniform, it is possible to improve the flashback-resistant property in the radially-inner flow path region 68*b* effectively.

In the swirler 70*c* in another embodiment illustrated in FIG. 14, the trailing edge 93 of the root portion 86 of the swirl vane 72*c* includes a curved surface 92*c*. However, the trailing edge 93 of the root portion 86 may not include the curved surface 92*c*. That is, the swirl vane 72*c* is configured such that the cutout-space forming surface 96 has a shape such that a width of the cutout space in the radial direction increases toward the downstream side, and the trailing edge 93 of the root portion 86 has a flat shape similarly to the trailing edge 114 of the comparison example. Specifically, the swirl vane 72*c* includes the tip portion 85 for swirling gas flowing through the radially-outer flow path region 68*a* of the axial flow path 68 in the swirl direction, and the root portion 86 disposed on the inner side, in the radial direction, of the nozzle 64 as seen from the tip portion 85 and having the cutout 90*c* at the side of the trailing edge. Further, at least in a range in the axial direction in which the swirl vane 72*c* is provided, the radially-outer flow path region 68*a* and the radially-inner flow path region 68*b* of the axial flow path 68 are communicating with each other without being partitioned. Moreover, the tip portion 85 includes, in the downstream region of the tip portion 85, a cutout-space forming surface 96 disposed on the outer side, in the radial direction, of a cutout space formed by the cutout 90*c* so as to face the cutout space, the cutout-space forming surface 96 having a shape such that the width, in the radial direction, of the cutout space increases toward the downstream side.

Figure 15:
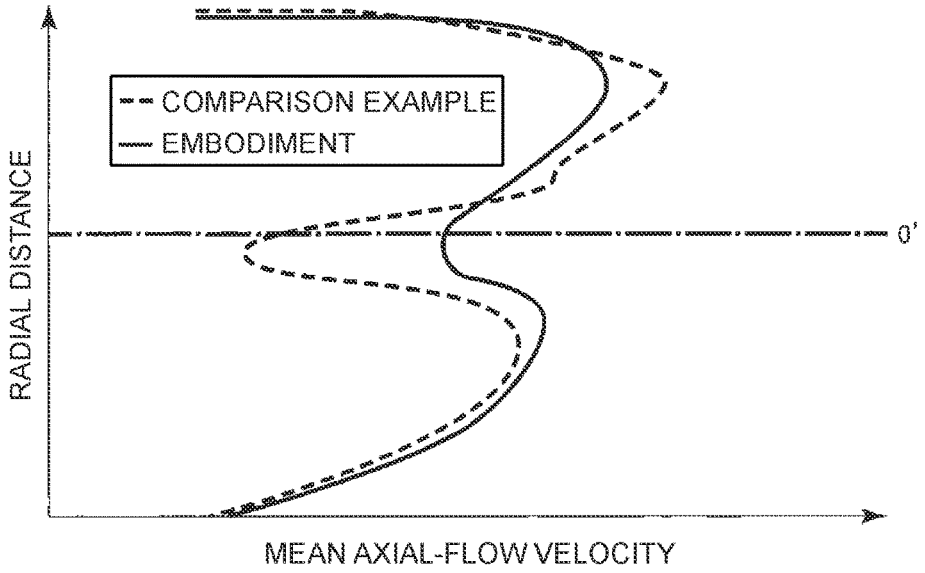
FIG. 15 is a graph showing a relationship between a mean axial-flow velocity and a radial distance at an outlet of an extension tube of the embodiment and the comparison example.

Now, with reference to FIG. 15, the flashback-resistant property of the combustion burner of the present embodiment will be compared to that of the comparison example. FIG. 15 is a graph showing a relationship between a mean axial-flow velocity and a radial distance at an outlet of an extension tube of the embodiment and the comparison example. In the drawing, the combustion burner in the embodiment includes the nozzle 64 and the swirler 70*c* illustrated FIG. 14, and the combustion burner in the comparison example includes the nozzle and the swirler illustrated in FIG. 8, and the mean axial-flow velocity of each case is shown.

In FIG. 14, the trailing edge 93 of the root portion 86 includes a curved surface 92*c*. However, in the following analysis, a swirl vane with the trailing edge 93 of the root portion 86 not having the curved surface 92*c* is used. That is, in the combustion burner of the present embodiment, the cutout-space forming surface 96 has a shape such that a width of the cutout space increases in the radial direction toward the downstream side, and the trailing edge 93 of the root portion 86 is formed in a flat shape similarly to the comparison example.

In each of the combustion burner in the present embodiment and the combustion burner in the comparison example, computational fluid dynamics (CFD) is used to calculate the mean axial-flow velocity with respect to the radial distance of the nozzles 64, 120.

As a result, in the combustion burner in the comparison example, the mean axial-flow velocity decreases more considerably in the radially-inner flow path region than in the radially-outer flow path region, and the mean axial-flow velocity at the center axis O' of the flow path decreases in the mean axial-flow velocity distribution (dotted line in FIG. 15) at the outlet of the extension tube.

On the other hand, in the combustion burner in the present embodiment, the mean axial-flow velocity in the radially-inner flow path region 68*b* is higher than that in the comparison example, and thus a decrease in the mean axial-flow velocity at the center axis O' of the flow path is suppressed in the mean axial-flow velocity distribution (solid line in FIG. 15) at the outlet 65*a* of the extension tube. Specifically, according to the present embodiment, the mean axial-flow velocity distribution at the outlet 65*a* of the extension tube is uniform as compared to that in the comparison example. As described above, it is possible to secure a large width where the flow mainly including the swirl flow in the radially-outer flow path region 68*a* and the flow mainly including the axial flow passing through the cutout 90*c* in the radially-inner flow path region 68*b* are to be mixed with each other, which makes it possible to equalize the flow-velocity distribution at the downstream side of the axial flow path 68.

According to the present embodiment, with the flow-velocity distribution at the downstream side of the axial flow path 68 being uniform, it is possible to improve the flash-back-resistant property in the radially-inner flow path region 68*b* effectively.

Figure 16:
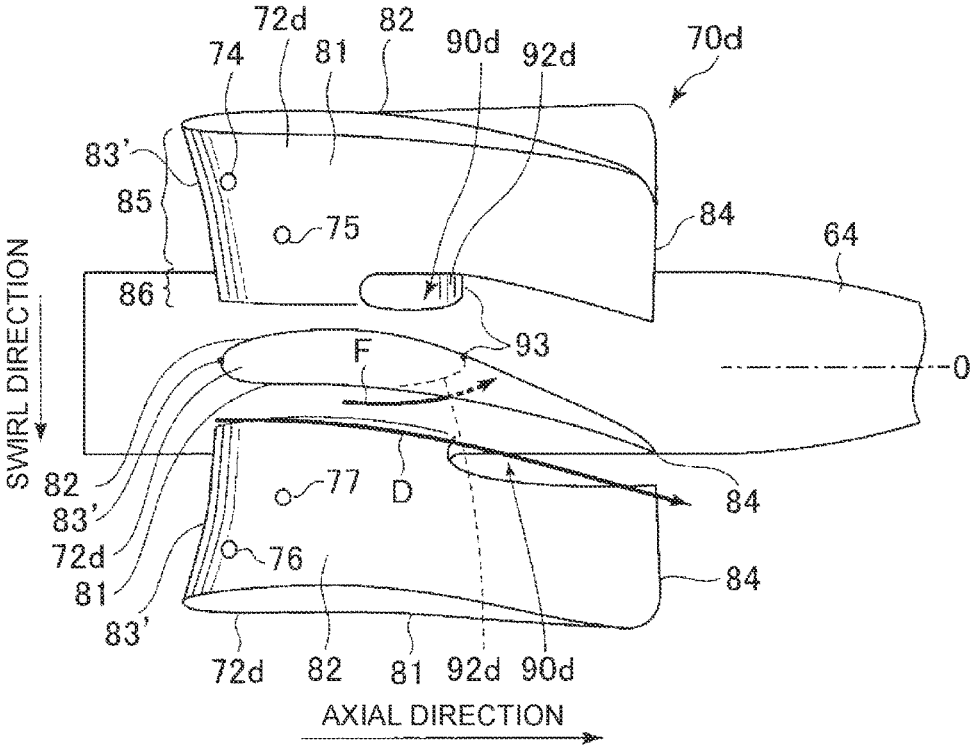
FIG. 16 is a side view of a nozzle and a swirler according to another embodiment.

FIG. 16 is a side view of a nozzle and a swirler according to another embodiment.

As illustrated in FIG. 16, the leading edge 83' of the swirl vane 72*d* is oblique to the radial direction so as to be oriented toward the upstream side in the axial direction toward the outer side in the radial direction of the nozzle 64, at least on the side of the tip portion 85. The leading edge 83' may be oblique over the entire region of the leading edge 83' of the swirl vane 72*d* in the radial direction or the nozzle 64. Alternatively, the leading edge 83' may be oblique in at least a partial region of the leading edge 83' in the radial direction of the nozzle 64, especially at the radially-outer side (a part corresponding to the radially-outer flow path region 68*a*) in the radial direction of the nozzle 64.

In this way, the flow of the gas gets closer to the radially-inner flow path region 68*b* (see FIG. 5) along the pressure gradient in the radial direction on the blade surface of the swirl vane 72*d*, and thus the flow rate in the radially-inner flow path region 68*b* increases relatively. As a result, the mean axial-flow velocity in the radially-inner flow path region 68*b* increases.

In the swirler 70*d* of another embodiment illustrated in FIG. 16, the swirl vane 72*d* includes a cutout 90*d* formed on the downstream side of the root portion 86. However, the cutout 90*d* may not be formed. Further, as described above with reference to the embodiment illustrated in FIG. 14, the swirl vane 72*d* in the other embodiment illustrated in FIG. 16 may include a cutout having a cutout-space forming surface such that the width of the cutout space in the radial direction increases toward the downstream side.

Embodiments of the present invention were described in detail above, but the present invention is not limited thereto, and various amendments and modifications may be implemented.

For instance, a combustion burner of a premix combustion type is described as an example in the above embodiment. The combustion burner of a premix combustion type is capable of suppressing a local increase in the combustion temperature and thus effective in restricting generation of NOx. However, the embodiment of the present invention can be applied to the combustion burner of a diffusive combustion type. In this case, an embodiment in which the swirl vanes do not have the fuel injection holes and there is nearly no fuel in the axial flow path is also included.

Further, while a two-dimensional airfoil is illustrated in the above embodiment, the embodiment of the present invention can be applied to a three-dimensional airfoil For instance, an expression of relative or absolute arrangement such as "in a direction", "along a direction", "parallel", "orthogonal", "centered", "concentric" and "coaxial" shall not be construed as indicating only the arrangement in a strict literal sense, but also includes a state where the arrangement is relatively displaced by a tolerance, or by an angle or a distance whereby it is possible to achieve the same function.

For instance, an expression of an equal state such as "same" "equal" and "uniform" shall not be construed as indicating only the state in which the feature is strictly equal, but also includes a state in which there is a tolerance or a difference that can still achieve the same function.

Further, for instance, an expression of a shape such as a rectangular shape or a cylindrical shape shall not be construed as only the geometrically strict shape, but also includes a shape with unevenness or chamfered corners within the range in which the same effect can be achieved.

On the other hand, an expression such as "comprise", "include", "have", "contain" and "constitute" are not intended to be exclusive of other components.

DESCRIPTION OF REFERENCE NUMERALS

1 Gas turbine
2 Compressor
4 Combustor
6 Turbine
8 Rotor
10 Compressor casing
22 Turbine casing
28 Exhaust casing
40 Combustor casing
46 Combustor liner
46*a* Combustor basket
46*b* Transition piece
50 Combustion burner (pilot combustion burner)
52 Fuel port
54 Nozzle (pilot nozzle)
56 Pilot cone
58 Swirler
60 Combustion burner (premix combustion burner)
62 Fuel port
64 Nozzle (main nozzle)
65 Extension tube
65*a* Extension tube outlet
66 Burner cylinder
68 Axial flow path
68*a* Radially-outer flow path region
68*b* Radially-inner flow path region
70, 70*a* to 70*d* Swirler
72, 72*a* to 72*d* Swirl vane
74 to 77 Injection aperture
81 Pressure surface
82 Suction surface
83, 83' Leading edge
84 Trailing edge

85 Tip portion
86 Root portion
86*a* Radially-outer flow path region
86*b* Radially-inner flow path region
90, 90*a* to 90*b* Cutout
91 Curved surface
92*a* to 92*d* Curved surface
93 Trailing edge
95 Stepped portion
96 Cutout-space forming surface

The invention claimed is:

1. A combustion burner comprising:

a nozzle; and a swirl vane disposed in an axial flow path extending along an axial direction of the nozzle around the nozzle, wherein the swirl vane includes a tip portion for swirling gas in a swirl direction, the gas flowing through a radially-outer region of the axial flow path, and a root portion disposed on an inner side in a radial direction of the nozzle as seen from the tip portion, the root portion having a cutout on a side of a trailing edge, wherein the radially-outer region and a radially-inner region of the axial flow path communicate with each other without being partitioned, at least in a range in the axial direction in which the swirl vane is disposed, wherein the swirl vane has a pressure surface, a downstream region of the pressure surface of the root portion being defined by the cutout as a curved surface which curves in a direction opposite to the swirl direction toward the trailing edge, wherein the trailing edge of the root portion of the swirl vane is formed by a downstream edge of the curved surface in the axial direction, the trailing edge of the root portion being disposed on an upstream side in the axial direction as compared to the trailing edge of the tip portion, wherein the pressure surface of the swirl vane at the tip portion has a curved surface curving in the swirl direction toward the trailing edge, and wherein the pressure surface of the swirl vane has a stepped portion between the curved surface of the tip portion and the curved surface of the root portion.

2. The combustion burner according to claim 1, wherein the trailing edge of the root portion of the swirl vane is disposed on an upstream side in the swirl direction, as compared to the trailing edge of the tip portion.

3. The combustion burner according to claim 2, wherein the trailing edge of the root portion of the swirl vane is disposed on a position same as that of a leading edge of the root portion, in a circumferential direction of the nozzle.

4. The combustion burner according to claim 1, wherein the airfoil of the root portion of the swirl vane has a line-symmetric shape with respect to a straight line parallel to the axial direction and passing through the trailing edge, at least on the side of the trailing edge.

5. The combustion burner according to claim 2, wherein the trailing edge of the root portion of the swirl vane is disposed on a side opposite to the trailing edge of the tip portion across a straight line parallel to the axial direction and passing through the leading edge, in the circumferential direction of the nozzle.

6. The combustion burner according to claim 1, wherein the curved surface at the root portion is configured to swirl gas in a direction opposite to the swirl direction, the gas flowing through the radially-inner region of the axial flow path.

7. The combustion burner according to claim 1, wherein a bisector of an angle formed by a tangent of the pressure surface passing through the trailing edge of the root portion and a tangent of a suction surface passing through the trailing edge of the root portion is oblique to the axial direction in a direction opposite to the swirl direction, at a downstream side of the trailing edge.

8. The combustion burner according to claim 1, wherein the leading edge of the swirl vane is oblique to the radial direction toward an upstream side in the axial direction as the leading edge gets closer to an outer side in the radial direction of the nozzle, at least on a side of the tip portion.

9. The combustion burner according to claim 1, wherein the tip portion includes a cutout-space forming surface disposed on a radially-outer side of a cutout space formed by the cutout, the cutout-space forming surface facing the cutout space, in a downstream region of the tip portion, and wherein the cutout-space forming surface has a shape such that a width of the cutout space in the radial direction increases toward a downstream side.

10. The combustion burner according to claim 9, wherein the cutout-space forming surface is a flat surface extending linearly and oblique to the axial direction so that the width of the cutout space in the radial direction increases toward the downstream side.

11. A combustor comprising:

the combustion burner according to claim 1, and a combustor liner for forming a flow path for guiding combustion gas from the combustion burner.

12. A gas turbine comprising:

a compressor for generating compressed air;

the combustor according to claim 11 configured to combust fuel with the compressed air from the compressor to generate combustion gas; and a turbine configured to be driven by the combustion gas from the combustor.

13. A combustion burner comprising:

a nozzle; and a swirl vane disposed in an axial flow path extending along an axial direction of the nozzle around the nozzle, wherein the swirl vane includes a tip portion for swirling gas in a swirl direction, the gas flowing through a radially-outer region of the axial flow path, and a root portion disposed on an inner side in a radial direction of the nozzle as seen from the tip portion, the root portion having a cutout on a side of a trailing edge, wherein the radially-outer region and a radially-inner region of the axial flow path communicate with each other without being partitioned, at least in a range in the axial direction in which the swirl vane is disposed, wherein the swirl vane has a pressure surface, a downstream region of the pressure surface of the root portion being defined by the cutout as a curved surface which curves in a direction opposite to the swirl direction toward the trailing edge, wherein the pressure surface of the swirl vane at the tip portion has a curved surface curving in the swirl direction toward the trailing edge, wherein the pressure surface of the swirl vane has a stepped portion between the curved surface of the tip portion and the curved surface of the root portion, wherein an airfoil of the root portion has a shape same as that of an airfoil of the tip portion in an upstream region, and has a shape such that a portion corresponding to the cutout is cut out from the airfoil of the tip portion in the downstream region, and wherein the trailing edge of the root portion of the swirl vane is formed by a downstream edge of the pressure surface of the root portion including the curved surface so as to be disposed on a suction surface of the airfoil of the root portion having the same shape as the tip portion.

* * * * *